US010315064B2

(12) United States Patent
Pinkus

(10) Patent No.: US 10,315,064 B2
(45) Date of Patent: Jun. 11, 2019

(54) BLOCK EXERCISE SYSTEM AND ATTACHMENTS

(71) Applicant: Dylan Pinkus, Bayside, WI (US)

(72) Inventor: Dylan Pinkus, Bayside, WI (US)

( * ) Notice: Subject to any disclaimer, the term of this patent is extended or adjusted under 35 U.S.C. 154(b) by 177 days.

(21) Appl. No.: 15/253,289

(22) Filed: Aug. 31, 2016

(65) Prior Publication Data

US 2017/0065845 A1 Mar. 9, 2017

Related U.S. Application Data

(60) Provisional application No. 62/214,398, filed on Sep. 4, 2015.

(51) Int. Cl.

| | |
|---|---|
| ***A63B 21/00*** | (2006.01) |
| ***A63B 71/00*** | (2006.01) |
| ***A63B 21/055*** | (2006.01) |
| ***A63B 23/035*** | (2006.01) |
| ***A63B 23/12*** | (2006.01) |
| *A63B 21/072* | (2006.01) |
| *A63B 23/04* | (2006.01) |
| *A63B 21/065* | (2006.01) |

(52) U.S. Cl.

CPC .... *A63B 21/4035* (2015.10); *A63B 21/00061* (2013.01); *A63B 21/0552* (2013.01); *A63B 23/03541* (2013.01); *A63B 23/1209* (2013.01); *A63B 21/0004* (2013.01); *A63B 21/00065* (2013.01); *A63B 21/065* (2013.01); *A63B 21/072* (2013.01); *A63B 21/0728* (2013.01); *A63B 21/4001* (2015.10); *A63B 21/4039* (2015.10); *A63B 23/03508* (2013.01); *A63B 23/03525* (2013.01); *A63B 23/0405* (2013.01); *A63B 23/047* (2013.01); *A63B 23/0458* (2013.01); *A63B 71/0036* (2013.01); *A63B 2225/093* (2013.01)

(58) Field of Classification Search

CPC ..... A63B 21/4035; A63B 21/00061; A63B 21/0552; A63B 23/03541; A63B 23/1209; A63B 21/4001; A63B 21/4039; A63B 21/0004; A63B 21/00065; A63B 21/065; A63B 21/072; A63B 21/0728; A63B 23/03508; A63B 23/03525; A63B 23/0405; A63B 23/0458; A63B 23/047; A63B 71/0036; A63B 2225/093

USPC ..... 482/139; 446/125

See application file for complete search history.

(56) References Cited

U.S. PATENT DOCUMENTS

| | | | | |
|---|---|---|---|---|
| 1,809,508 | A * | 6/1931 | Colby | A63H 33/105 376/459 |
| 6,648,715 | B2 * | 11/2003 | Wiens | A63H 33/062 446/121 |
| 7,144,351 | B2 * | 12/2006 | Kastelic | A63B 23/0458 482/52 |
| 7,824,319 | B2 * | 11/2010 | Carlesimo | A63B 21/00047 446/85 |
| 8,052,587 | B1 * | 11/2011 | Wu | A63B 23/0458 446/125 |
| 8,998,778 | B2 * | 4/2015 | Potts | A63B 21/0724 482/104 |

(Continued)

*Primary Examiner* — Andrew S Lo

(74) *Attorney, Agent, or Firm* — Greensfelder, Hemker & Gale, P.C.

(57) ABSTRACT

An exercise system in the form of a block having a plurality of locations for attachments is disclosed. The attachments can be utilized to create a variety of different exercises using the block.

20 Claims, 15 Drawing Sheets

(56) References Cited

U.S. PATENT DOCUMENTS

2003/0199375 A1* 10/2003 Edwards ..... A63B 21/0004 482/148
2006/0189449 A1* 8/2006 Flentye ..... A63B 23/0458 482/52
2007/0161476 A1* 7/2007 Davies ..... A63B 21/00047 482/142
2009/0023563 A1* 1/2009 Liang ..... A63B 21/072 482/106
2009/0247378 A1* 10/2009 Carlesimo ..... A63B 21/00047 482/141
2010/0178981 A1* 7/2010 Holcomb ..... A63B 21/0603 463/37
2010/0210173 A1* 8/2010 Maggiore ..... A63H 33/062 446/125
2011/0224050 A1* 9/2011 Larish ..... A63B 21/015 482/93
2011/0230318 A1* 9/2011 Carlesimo ..... A63B 21/00047 482/141
2012/0214653 A1* 8/2012 Tsou ..... A63B 21/00047 482/142
2012/0329623 A1* 12/2012 Ramirez ..... A63B 21/00047 482/139
2013/0029815 A1* 1/2013 Lu ..... A63B 21/0004 482/142
2013/0172160 A1* 7/2013 Poole ..... A63B 21/0552 482/129
2013/0274078 A1* 10/2013 Andrews ..... A63B 23/1227 482/141
2014/0051554 A1* 2/2014 Walker ..... A63B 15/00 482/109
2014/0057763 A1* 2/2014 Fritsch ..... A63B 21/06 482/109
2014/0066262 A1* 3/2014 Kennedy ..... A63B 21/0004 482/52
2014/0073491 A1* 3/2014 Gilson ..... A63B 21/06 482/93
2015/0258363 A1* 9/2015 Kampinski ..... A63B 21/4035 482/139

* cited by examiner

BLOCK EXERCISE SYSTEM AND ATTACHMENTS

CROSS-REFERENCE TO RELATED APPLICATIONS

The present invention claims the benefit of U.S. Provisional Patent Application No. 62/214,398, filed Sep. 4, 2015, the contents of which are incorporated herein by reference.

FEDERALLY SPONSORED RESEARCH OR DEVELOPMENT

N/A

FIELD OF THE INVENTION

The present invention generally relates to a block exercise system having a plurality of attachments for various exercises that can be implemented on the system.

BACKGROUND OF THE INVENTION

There are many exercise systems that are advertised for full workouts. However, many of these systems are difficult to use and/or modify for different exercises. Additionally, such systems are limited in the number of different exercises that can be performed.

The present invention provides an improved exercise system that is easy to set up or modify and can be used to perform a variety of exercises for a full workout.

SUMMARY OF THE INVENTION

The present invention provides a block exercise system having a plurality of attachments for enabling a user to utilize the system for a variety of different exercises. The block is provided with a number of locations for removably connecting the attachments.

In accordance with one aspect of the invention an exercising system is provided. The exercise system comprises a generally rectangular block having a top wall, a bottom wall, a first side wall and an opposing second side wall, a first end wall and an opposing second end wall. A plurality of attachment locations (such as circular openings) are positioned on the block. The block includes at least a first handle.

The system includes a plurality of items that can be removably attached to the block. This includes one or more poles. A sled attachment can be connected to the bottom wall.

Handles and straps can also be removably connected to the block system. A cylindrical locking mechanism can be used to removably connect the various items.

In accordance with another aspect of the invention, a block exercising system for multiple exercise activities is provided. The block exercising system comprises a main body in the form of a rectangular box having a bottom wall, a top wall, a first side wall, a second side wall, a first end wall and a second end wall. A first handle forming a portion of a top edge of the first side wall and a first edge of the top wall is provided as well as a second handle forming a portion of a top edge of the second side wall and a second edge of the top wall. The box includes at least a first aperture for receiving an attachment.

Each of the first and second side walls and first and second end walls can be formed from polyethylene or other similar materials. Additionally, the box can be filled with an expandable foam, such as a polystyrene foam.

In addition to the first and second handles, the box can include a third handle forming a portion of a top edge of the first end wall and a third edge of the top wall, and a fourth handle forming a portion of a top edge of the second end wall and a fourth edge of the top wall.

The first aperture can be positioned on the top wall. Additionally, the box can include a second aperture on another wall, such as the first side wall, or a plurality of additional apertures for attachments on any of the walls.

The block exercising system can include a variety of attachments secured to the box. For example, the system can include one or more pole attachments secured in one of the apertures on the box, a sled attachment connected to the bottom wall, and/or one or more straps connected to one or more walls of the box.

Further aspects of the invention are disclosed in the Figures, and are described herein.

BRIEF DESCRIPTION OF THE DRAWINGS

To understand the present invention, it will now be described by way of example, with reference to the accompanying drawings in which.

DETAILED DESCRIPTION

Figure 1:
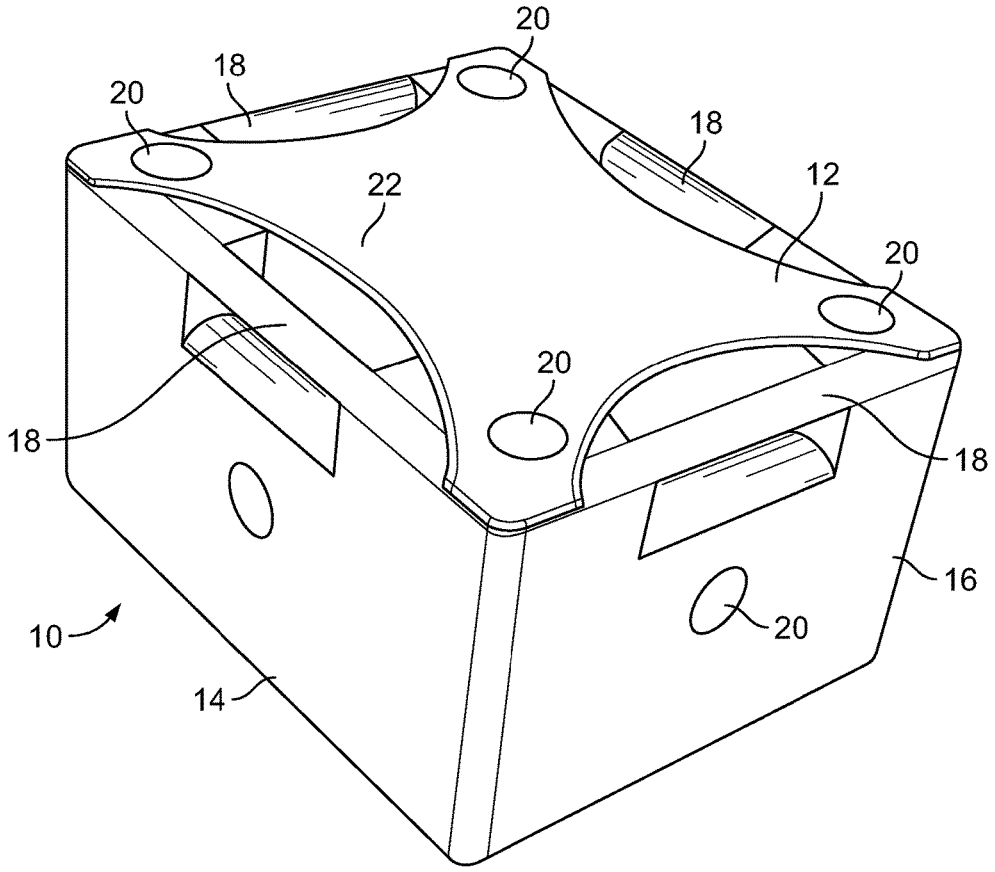
FIG. 1 is a perspective view of a block exercise system in accordance with the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a block exercise system (sometimes referred to herein as an "exercise block" or simply "block") 10 that can be utilized for a variety of exercises. The exercise block 10 is configured to receive numerous attachments to adapt the block 10 for certain exercises.

As illustrated in FIG. 1, the exercise block 10 is generally a rectangular block having a top surface or wall 12, side walls 14, end walls 16 and a bottom wall. The block 10 also includes four integrally formed handles 18 and circular openings 20 at various attachment locations on the block 10. In an alternative embodiment, one or more of the handles 18 can be removably connected to the block 10. The openings are used to removably attach other exercise items to the block. The number of handles 18 and/or openings 20 can be increased or decreased as desired. Moreover, each can be located at different positions on the block 10. While the openings are shown as cylindrical, other shapes can be utilized. Moreover, the block can be provided with other types of attachment structure (e.g., structure that extends outward from the block 10 as opposed to openings 20).

The exercise block 10 is preferably formed from foam and/or hard plastic. Other similar or suitable materials can also be used. In one embodiment, the block 10 is in the form of a rectangular plastic box with multiple handles and holes for attachments. The box can be 12"×16"×20" and is manufactured through a rotomold process using high density polyethylene plastic and filled with an expandable polystyrene foam. The combination of materials give the block 10 superior strength and rigidity while allowing it to be also be lightweight (e.g., under 10 lbs.).

The walls can be smooth or have a textured surface. Additionally, the handles can include materials (e.g., rubber) to enhance gripping the block 10, and/or can be ergonomically configured to provide a better grip (e.g., molded-in finger grooves).

The exercise block 10 shown in FIG. 1 includes a central top portion 22 that extends to the corners of the top wall 12. The top portion 22 can be molded into the remainder of the block 10. Each corner of the top surface 12 is provided with an opening 20. A handle 18 is formed along the edges of the top wall 12 (as well as the top portion of the side walls 14 and end walls 16). A centrally positioned opening 20 is shown on the side wall 14 and end wall 16 facing the viewer. The other side wall or end wall can have a similar configuration or could include additional openings (see, e.g., the end wall in FIGS. 2 or 3 having two openings) or no openings.

The exercise block 10 can be used for a variety of exercises without any modification or attachments. For example, the block 10 can be used for step aerobics or other similar exercises. The block 10 can be placed on a side wall 14 or end wall 16 to adjust the height for such exercises. Additionally, the handles can be utilized for various lifting and/or curling exercises. Exercise blocks 10 of varying sizes and weights can be manufactured to accommodate individuals of various sizes and/or abilities.

A variety of other exercises can be implemented with the exercise block 10 by utilizing various attachments to the system. FIGS. 2-13 and 15 show a variety of different attachments.

Figure 2:
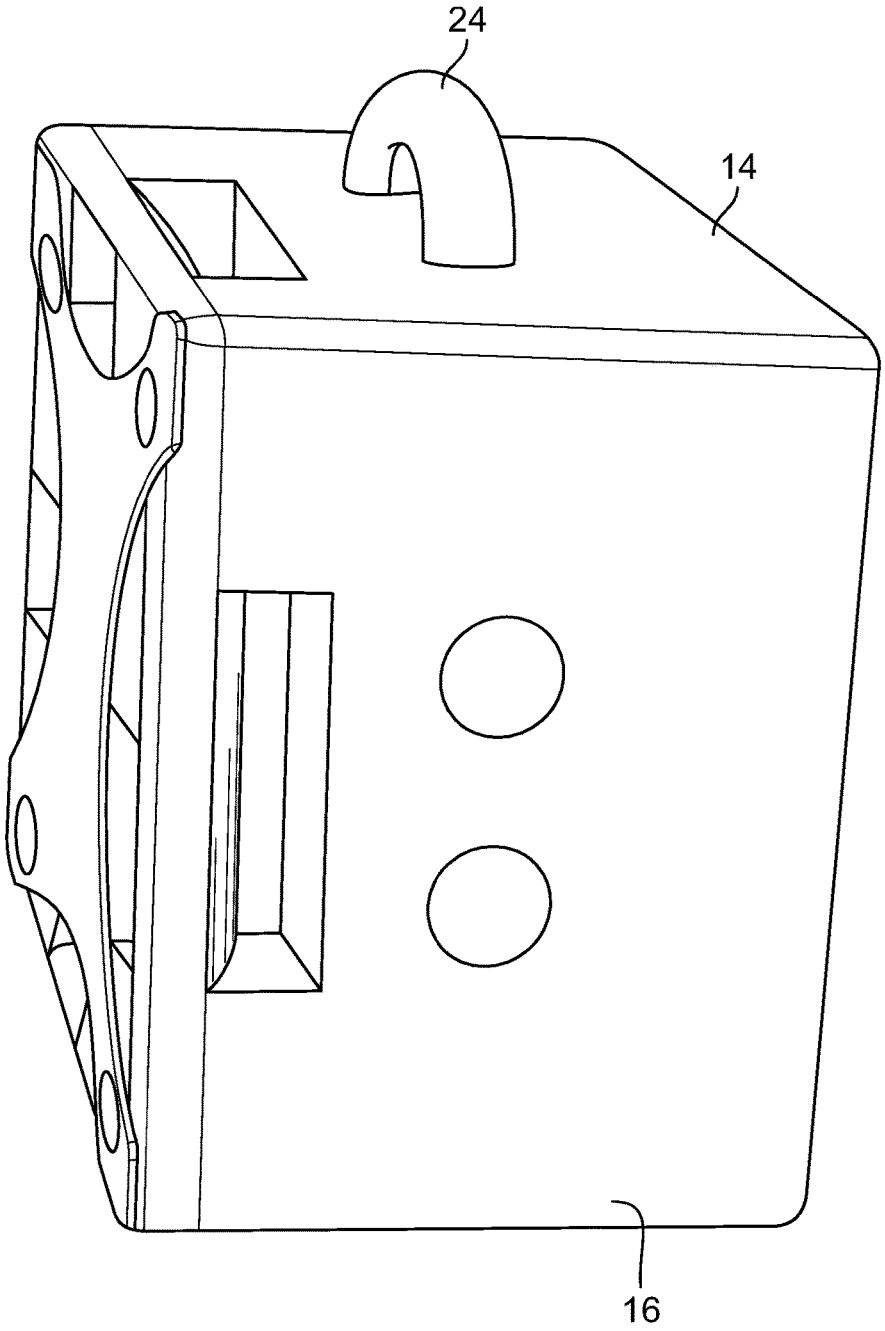
FIG. 2 is a perspective view of a block exercise system with an additional handle extending from a side of the system.
Figure 3:
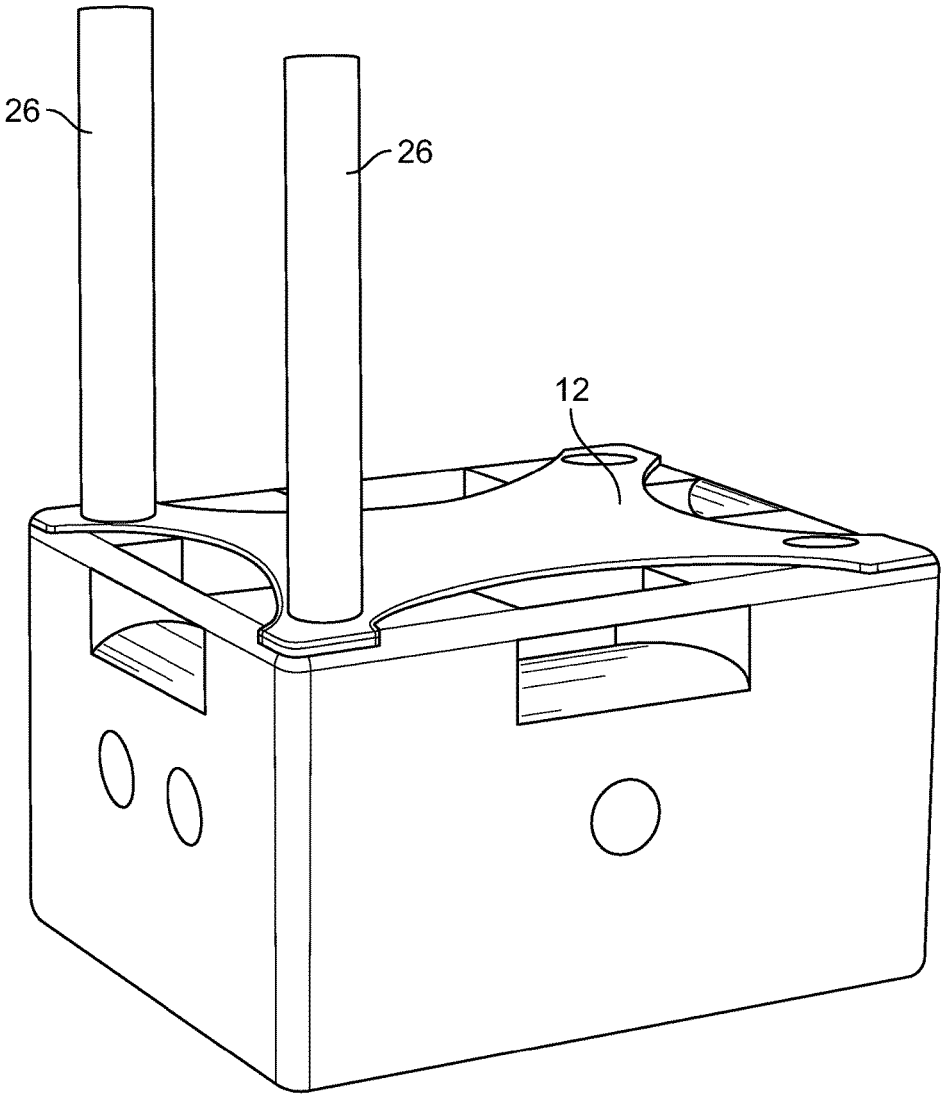
FIG. 3 is a perspective view of a block exercise system with two poles connected to a top of the system.
Figure 4:
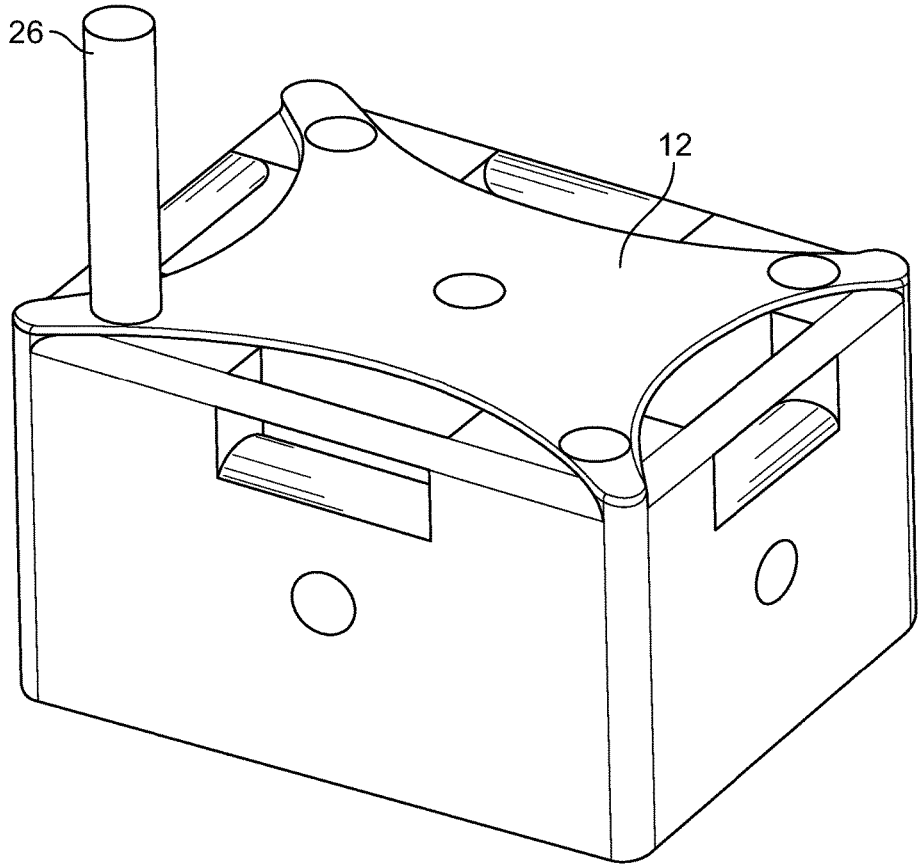
FIG. 4 is a perspective view of a block exercise system with a single stabilization pole extending from a top of the system.
Figure 5:
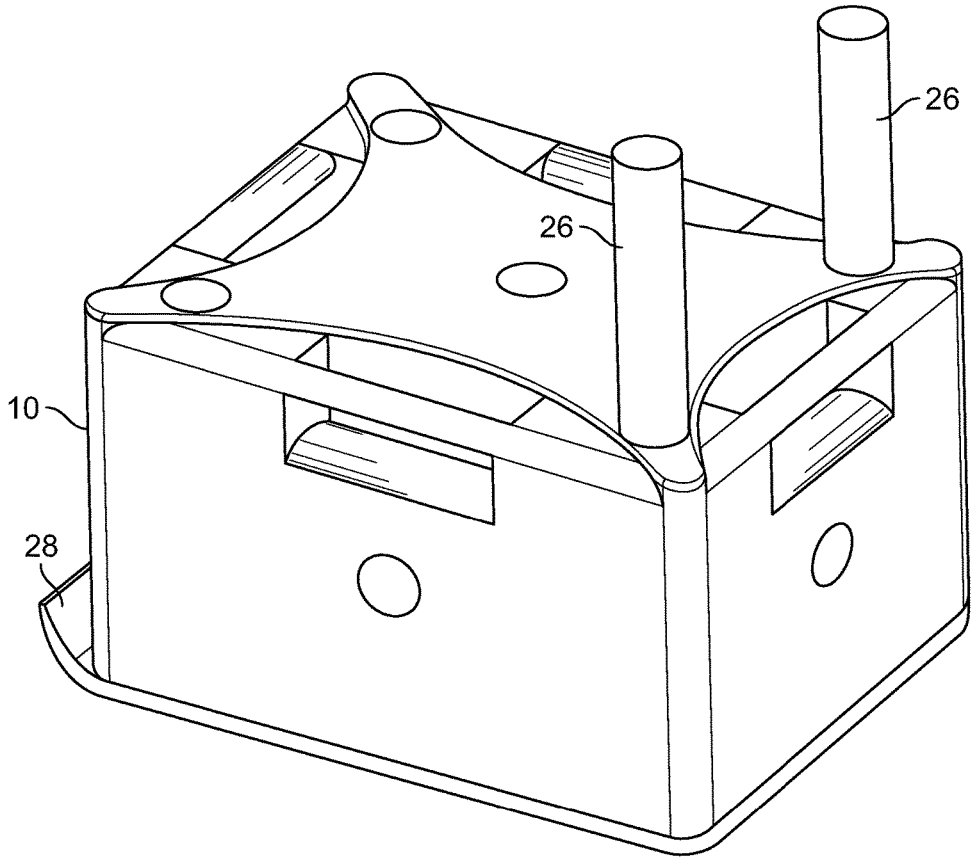
FIG. 5 is a perspective view of a block exercise system configured as a push sled.
Figure 15:
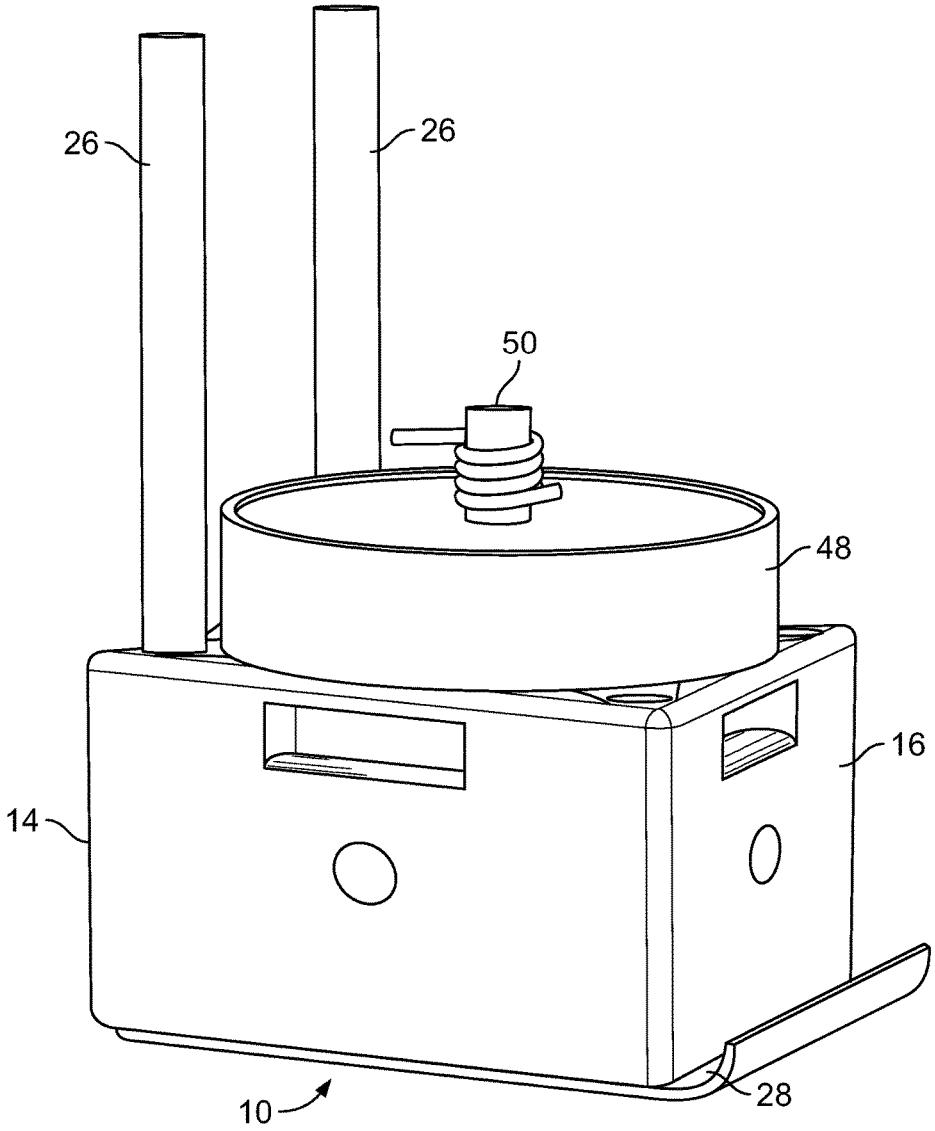

FIG. 2 shows a handle 24 extending outward from a side wall 14 of the system. FIGS. 3 and 4 show poles 26 extending upward from the top wall 12 of the block 10. As shown in FIGS. 5 and 15, the block 10 with two poles 26 can be mounted on a sled 28 and be used as a push sled.

As is evident in FIG. 15, extra weights 48 can be loaded on a center post 50 connected to the sled to increase the difficulty. In this embodiment the block 10 includes a centrally located opening on the top wall 12.

Figure 6:
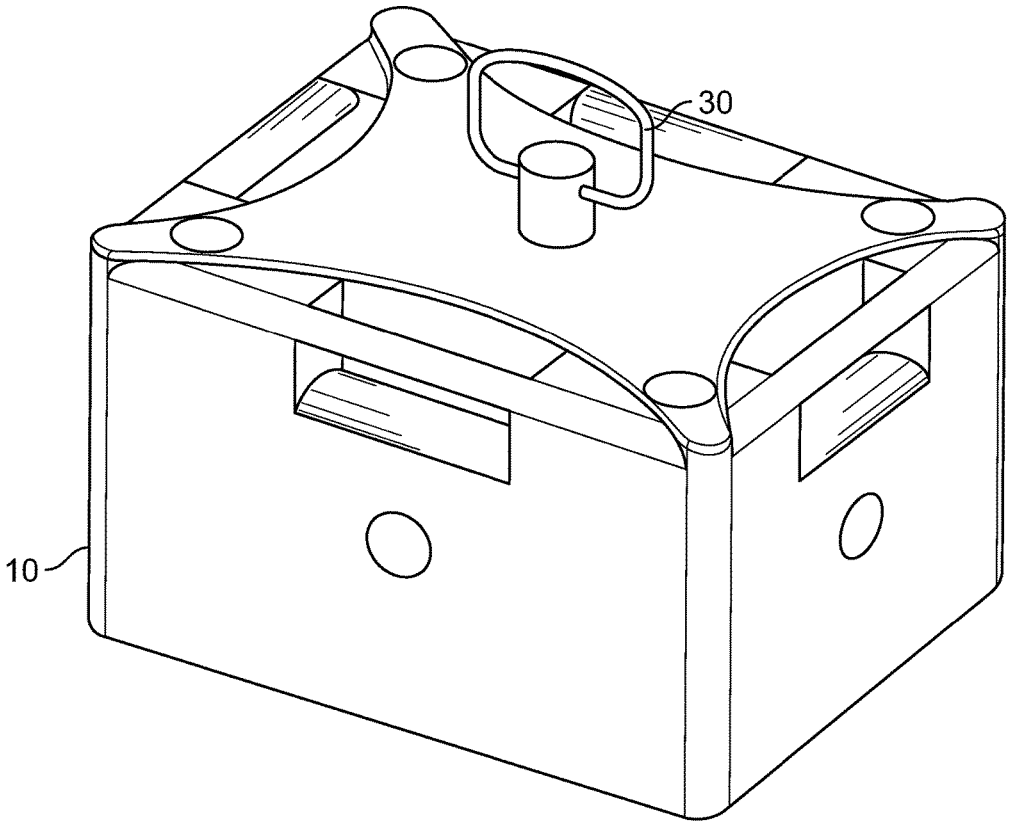
FIG. 6 is a perspective view of a block exercise system with a handle extending from a top of the system.

FIG. 6 shows a handle 30 extending upward from the top wall 12. This enables one to use the system as a bell weight. Similar to the block 10 in FIG. 15, the block 10 in FIG. 6 includes a centrally located opening on the top wall 12 (also see FIG. 7).

Figure 7:
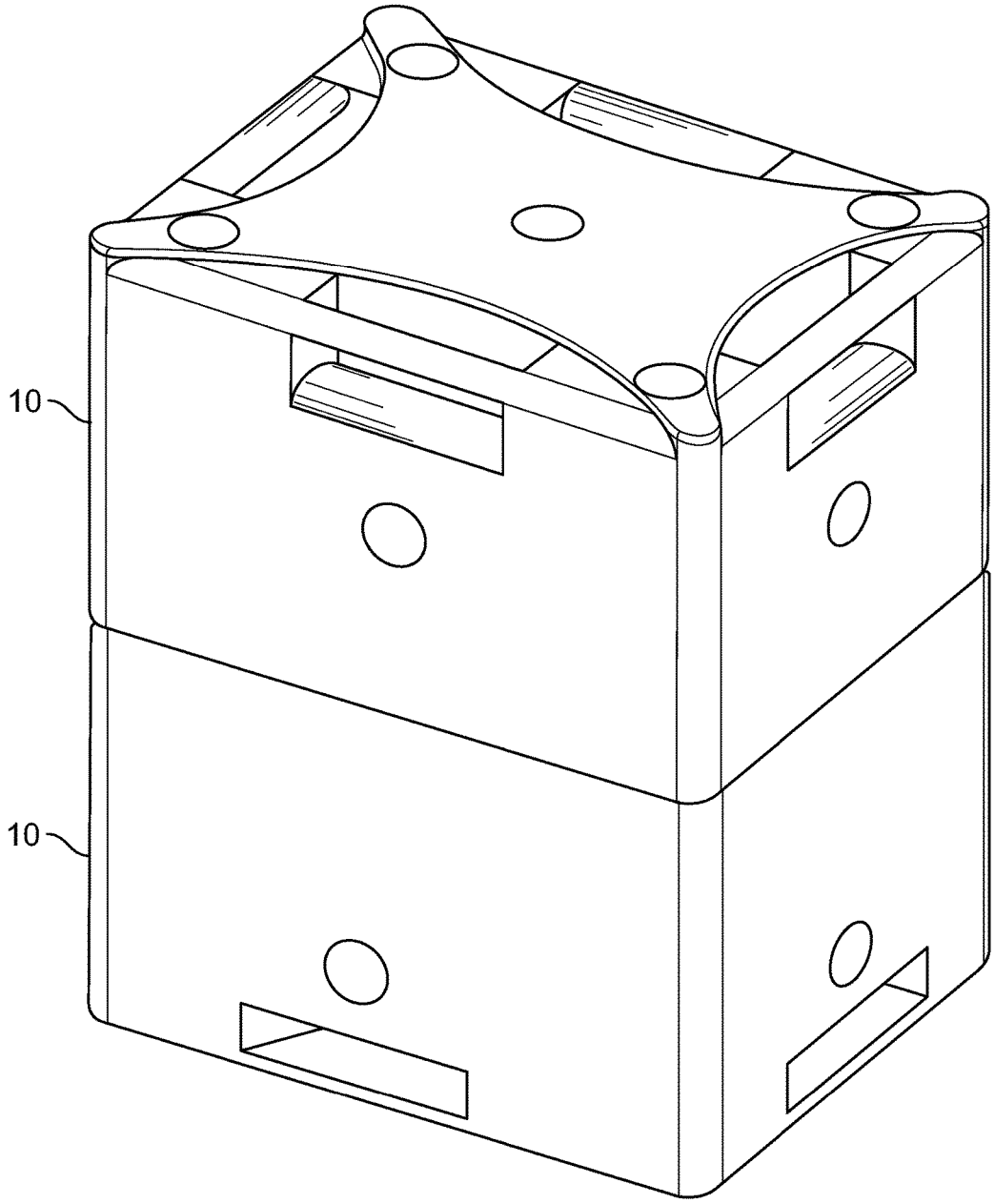
FIG. 7 is a perspective view of a first block exercise system stacked on a second block exercise system.

FIG. 7 shows two exercise blocks 10 stacked one on top of the other. The bottom block 10 is upside down. However, the blocks can stack in other orientations as well (e.g., the bottom shelf can be upright rather than upside down).

Figure 8:
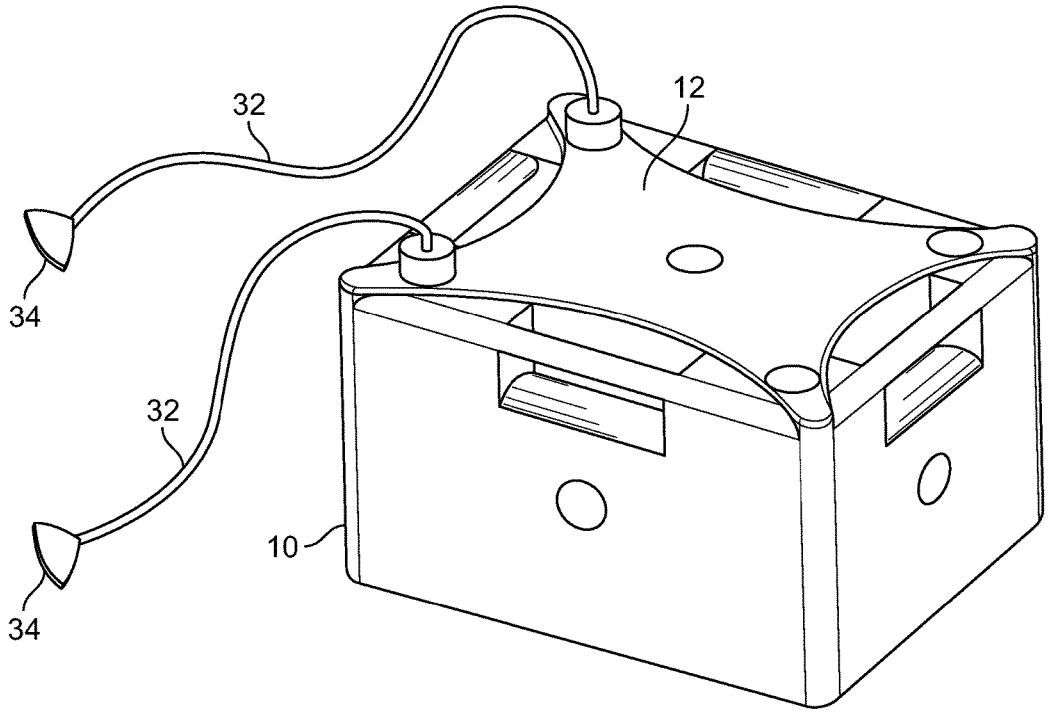
FIG. 8 is a perspective view of a block exercise system with elastic bands extending from a top of the system.

FIG. 8 shows the block 10 with two elastic bands 32 with handles 34 connected to the top wall 12. These can be used for various arm and leg exercises.

Figure 9:
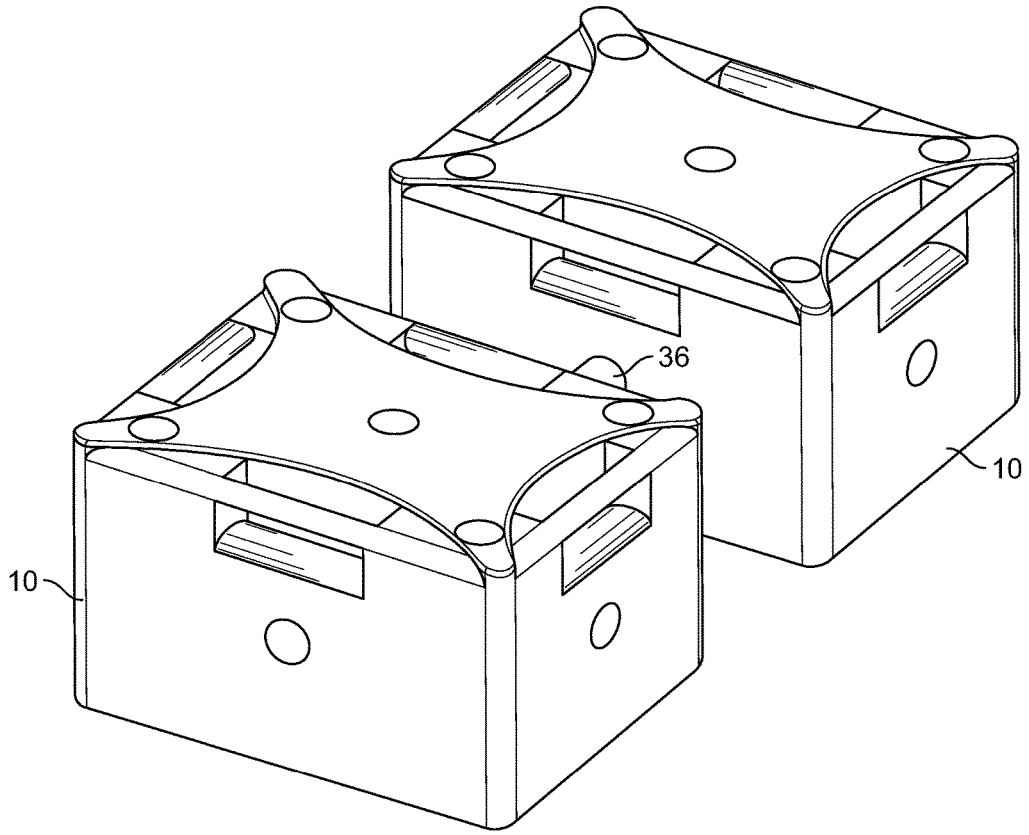
FIG. 9 is a perspective view of a first block exercise system connected to a second block exercise system by a pole.

FIG. 9 shows a first exercise block 10 connected to a second exercise block 10 by a pole 36.

Figure 10:
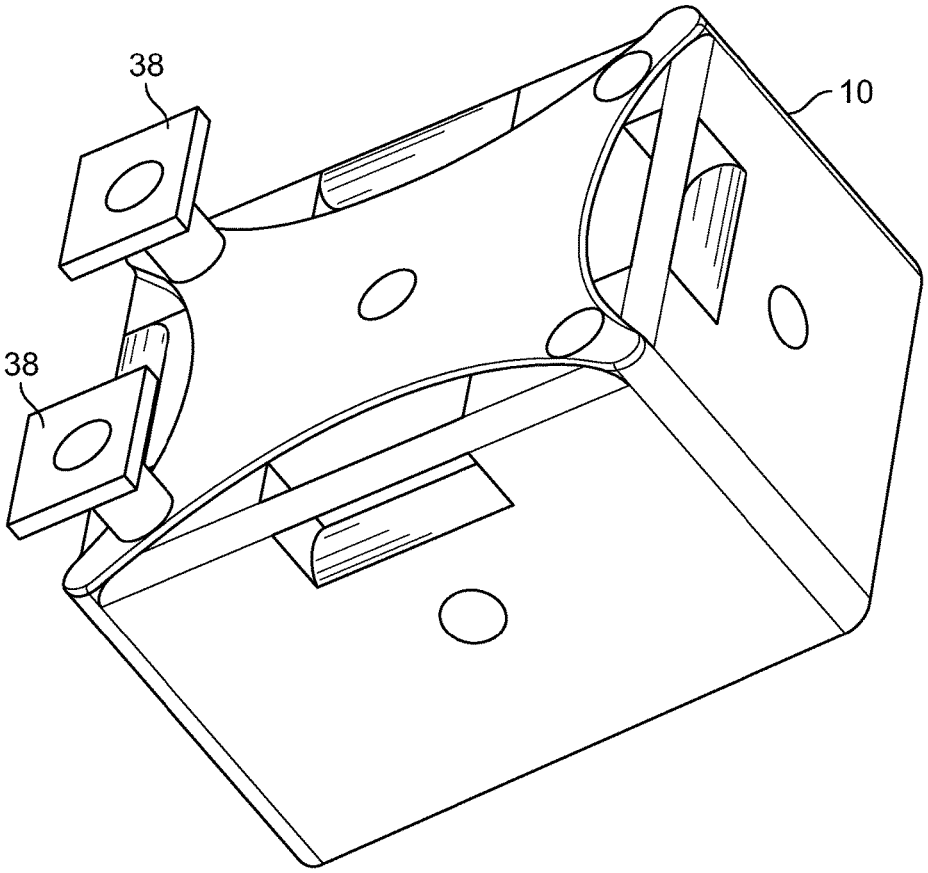
FIG. 10 is a perspective view of a block exercise system with a first stabilization adapter and a second stabilization adapter.

FIG. 10 shows an exercise block with two stabilization adapters 38.

Figure 11:
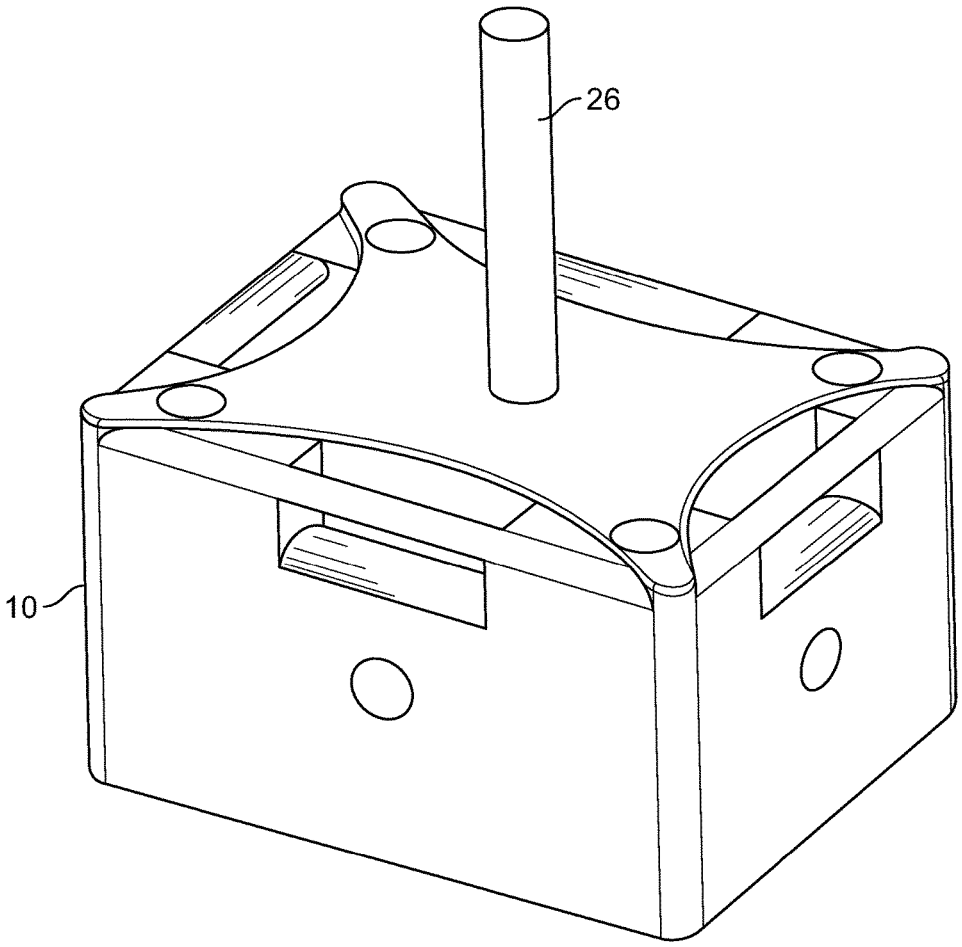
FIG. 11 is a perspective view of a block exercise system with a center weight pole adapter.

FIG. 11 shows the exercise block with a single pole 26 in the center of the top wall 12. One or more weights can be stacked on the pole 26.

Figure 12:
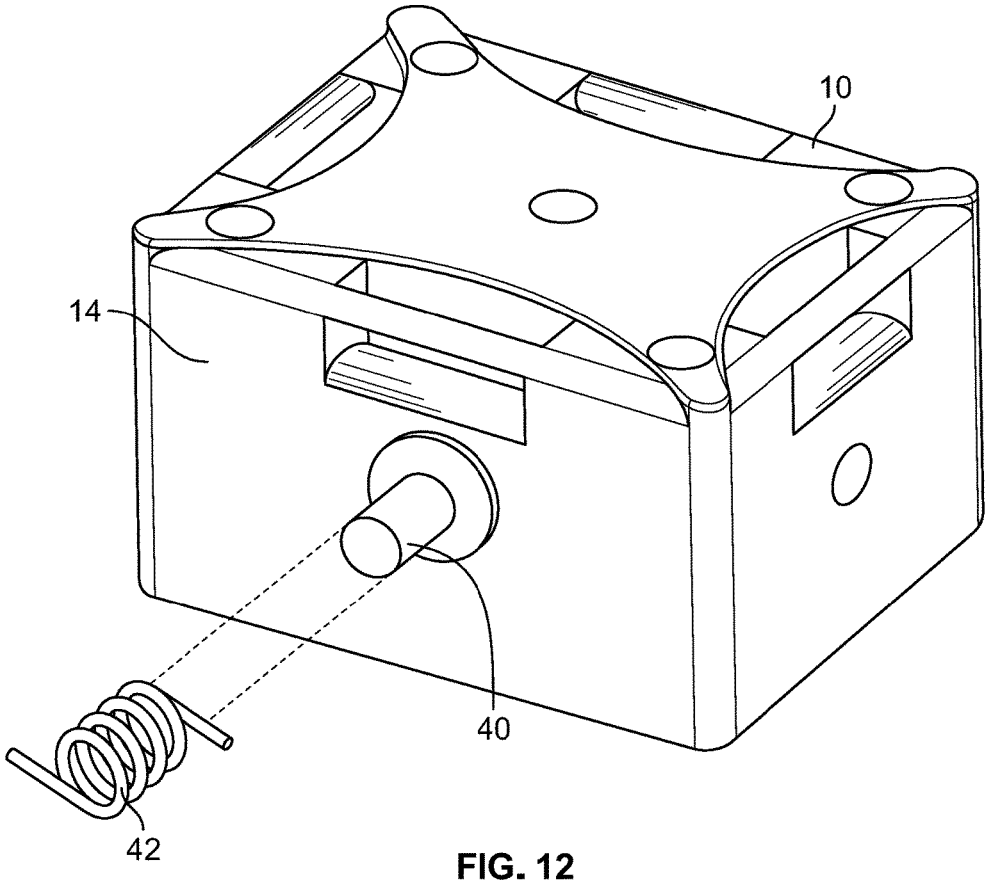
FIG. 12 is a perspective view of a block exercise system with a side weight adapter.

FIG. 12 shows a shortened pole 40 extending outward from the side wall 14, and a spring clip 42. Weights can be placed on the pole 40 and secured by the spring clip 42.

Figure 13:
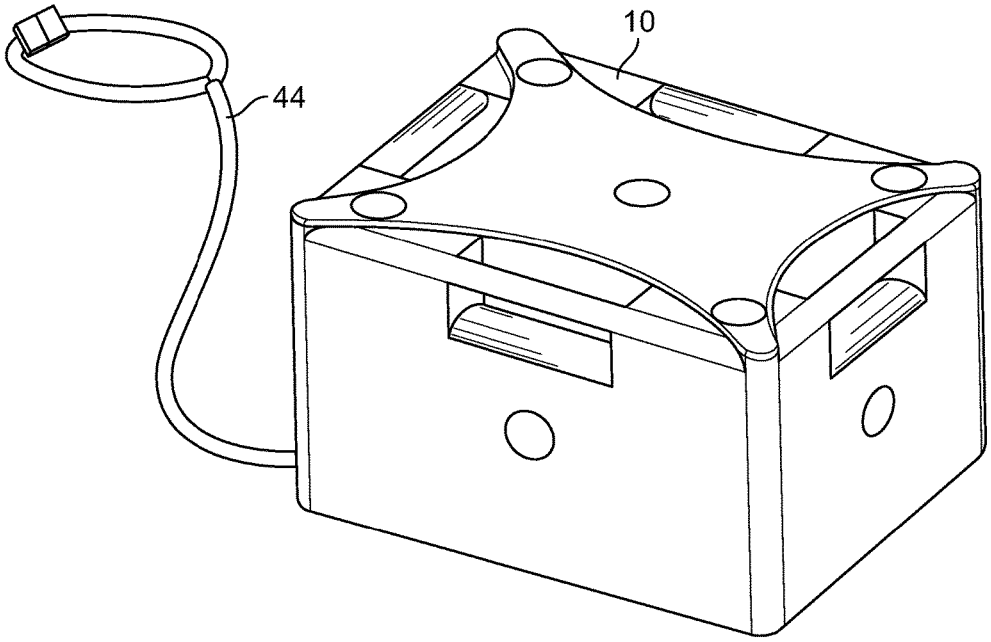
FIG. 13 is a perspective view of a block exercise system with a power harness connected to one end.

FIG. 13 shows an exercise block 10 with a power harness 44 connected to an end of the block 10.

Figure 14:
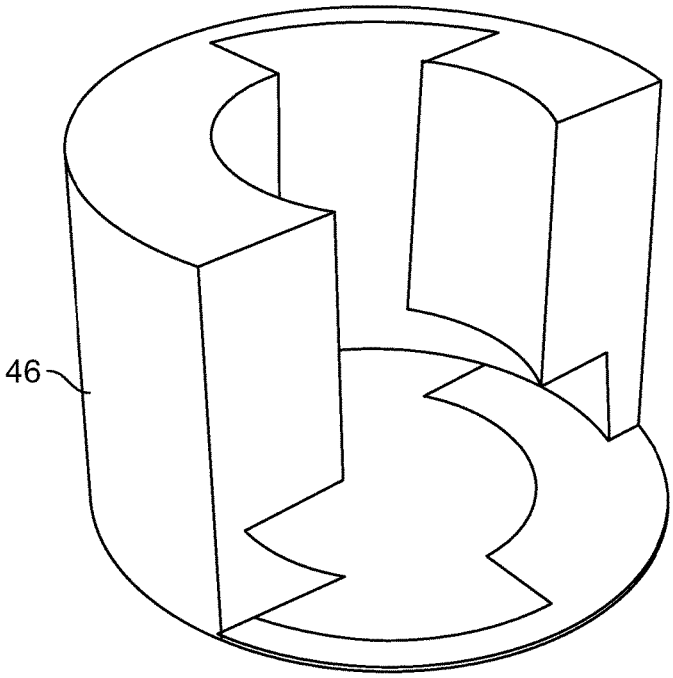
FIG. 14 is a perspective view of an attachment mechanism for use in securing various attachments to the block exercise system of FIG. 1; and, FIG. 15 is a perspective view of a block exercise system of FIG. 5 configured as a push sled with additional weights.

Each of the attachments shown can include a locking mechanism 46 for connecting the attachment to an opening 20 of the exercise block 10. One such locking mechanism 46 is shown in FIG. 14.

In one embodiment, the block 10 can be hollow or include an interior compartment for carrying some or all of the attachment items. A door, or hingeably connected wall panel, can be provided for accessing the compartment. In a further alternative embodiment, recessed spaces can be provided in one or more of the walls (e.g., on the bottom wall) for receiving and holding some or all of the attachment items. In a further embodiment, items such as the straps with handles can be retractably mounted in the block.

Many modifications and variations of the present invention are possible in light of the above teachings. It is, therefore, to be understood within the scope of the appended claims the invention may be protected otherwise than as specifically described.

I claim:

1. An exercising system comprising:

a generally rectangular block having a top wall, a bottom wall, a first side wall and an opposing second side wall perpendicular to the top wall and the bottom wall, a first end wall and an opposing second end wall perpendicular to the top wall and the bottom wall;

a plurality of additional exercise equipment items attachment locations located on the block; and, a first handle along an edge of the top wall and the first end wall and a first opening in the top wall adjacent the first handle and extending to a first opening in the first end wall adjacent the first handle;

a second handle along an edge of the top wall and the second end wall and a second opening in the top wall adjacent the second handle and extending to a second opening in the second end wall adjacent the second handle.

2. The system of claim 1 further comprising a first pole extending upward above the top wall, the first pole removably attached to the block at a first location of the plurality of attachment locations.

3. The system of claim 2 further comprising a second pole extending upward above the top wall, the second pole removably attached to the block at a second location of the plurality of attachment locations.

4. The system of claim 3 wherein the first location and the second location are proximate a first corner of the top wall and proximate a second corner of the top wall.

5. The system of claim 4 further comprising a sled connected to the bottom wall of the block.

6. The system of claim 1 further comprising a central handle connected to a central location on the top wall of the block midway between the first handle and the second handle, the central handle extending upward above the top wall.

7. The system of claim 1 further comprising a first elastic strap connected at a first end to the block and to a strap handle at a second end, and a second elastic strap connected at a first end to the block and to a strap handle at a second end.

8. The system of claim 1 wherein each of the plurality of attachment locations on the block is a circular opening.

9. The system of claim 8 wherein the additional exercise equipment items are attached to the block with a cylindrical locking mechanism.

10. A block exercising system for multiple exercise activities comprising:

a main body in the form of a rectangular box having a bottom wall, a top wall, a first side wall, a second side wall, a first end wall and a second end wall; the first and second side walls and first and second end walls extending between the bottom wall and the top wall;

a first handle forming a portion of a top edge of the first side wall and a first edge of the top wall, a first opening in the top wall adjacent the first handle which extends to a first opening in the first side wall adjacent the first handle, and a second handle forming a portion of a top edge of the second side wall and a second edge of the top wall, a second opening in the top wall adjacent the second handle which extends to a first opening in the second side wall adjacent the second handle; and, a first aperture for receiving an additional exercise equipment item.

11. The block exercising system of claim 10 wherein each of the first and second side walls and first and second end walls is formed from polyethylene.

12. The block exercising system of claim 10 wherein the box is filled with an expandable foam.

13. The block exercising system of claim 12 wherein the foam is polystyrene.

14. The block exercising system of claim 10 further comprising a third handle forming a portion of a top edge of the first end wall and a third edge of the top wall, a third opening in the top wall adjacent the third handle which extends to a first opening in the first end wall adjacent the third handle, and a fourth handle forming a portion of a top edge of the second end wall and a fourth edge of the top wall, a fourth opening in the top wall adjacent the fourth handle which extends to a first opening in the second end wall adjacent the fourth handle.

15. The block exercising system of claim 10 wherein the first aperture is on the top wall.

16. The block exercising system of claim 10 further comprising a second aperture for receiving an additional exercise equipment item on the first side wall.

17. The block exercising system of claim 10 further comprising a plurality of additional apertures for attachments.

18. The block exercising system of claim 17 further comprising a pole attachment that extends outward from the box secured in one of the apertures on the box.

19. The block exercising system of claim 17 further comprising a sled attachment connected to the bottom wall.

20. The block exercising system of claim 17 further comprising a first strap connected to the first end wall of the block, and a second strap connected to the first end wall of the block.

* * * * *